US009780470B2

(12) United States Patent
Gutmann et al.

(10) Patent No.: US 9,780,470 B2
(45) Date of Patent: Oct. 3, 2017

(54) CONTACT DEVICE SYSTEM

(71) Applicant: Micronas GmbH, Freiburg (DE)

(72) Inventors: Johannes Gutmann, Staufen (DE); Timo Kaufmann, Waldkirch-Suggental (DE); Klaus Heberle, Emmendingen (DE); Mike Kunze, Senden (DE); Till Feger, Freiburg (DE); Georg Sammel, Denzlingen (DE)

(73) Assignee: TDK-Micronas GmbH, Freiburg (DE)

( * ) Notice: Subject to any disclaimer, the term of this patent is extended or adjusted under 35 U.S.C. 154(b) by 0 days.

(21) Appl. No.: 15/243,315

(22) Filed: Aug. 22, 2016

(65) Prior Publication Data

US 2017/0054238 A1 Feb. 23, 2017

(30) Foreign Application Priority Data

Aug. 20, 2015 (DE) ..... 10 2015 010 776

(51) Int. Cl.

| | |
|---|---|
| ***H01R 12/00*** | (2006.01) |
| ***H01R 12/71*** | (2011.01) |
| ***H01R 12/73*** | (2011.01) |
| ***H01R 13/621*** | (2006.01) |
| *H01R 12/85* | (2011.01) |

(52) U.S. Cl.

CPC ..... *H01R 12/714* (2013.01); *H01R 12/73* (2013.01); *H01R 13/621* (2013.01); *H01R 12/85* (2013.01)

(58) Field of Classification Search

CPC ..... H01R 12/85

USPC ..... 439/73, 331

See application file for complete search history.

(56) References Cited

U.S. PATENT DOCUMENTS 4,878,846 A * 11/1989 Schroeder ..... H01L 21/67144 257/724
5,099,393 A * 3/1992 Bentlage ..... H01L 23/32 174/541
5,175,491 A * 12/1992 Ewers ..... H05K 3/325 324/750.05
5,528,466 A 6/1996 Lim et al.

(Continued)

FOREIGN PATENT DOCUMENTS

DE 11 2010 004 846 T5 10/2012
JP 2004-085424 A 3/2004

*Primary Examiner* — Tho D Ta

(74) *Attorney, Agent, or Firm* — Muncy, Geissler, Olds & Lowe, P.C.

(57) ABSTRACT

A contact device system having a plate-shaped carrier and at least five accommodating areas are disposed on a bottom side of the pressing unit, at least five accommodating areas and at least five contact area pairs are disposed on a top side of the carrier. The contact area pairs each have a first and second electrically conductive contact area, and in each case the first contact area is spaced apart from the second contact area and insulated electrically therefrom. The first and second contact areas have a functional electrical connection to an evaluation circuit via a trace section. The carrier has a plurality of accommodating areas for a packaged electronic component, that each have one of the at least five contact area pairs. The electronic components have at least two terminal contacts, whereby after accommodation of the packaged electronic components, the terminal contacts of the particular component are pressed down.

25 Claims, 4 Drawing Sheets

(56) References Cited

U.S. PATENT DOCUMENTS

| | | | | |
|---|---|---|---|---|
| 6,407,566 | B1 * | 6/2002 | Brunelle | G01R 1/0408<br>324/756.02 |
| 8,118,602 | B2 | 2/2012 | Beaman | |
| 2007/0020964 | A1 * | 1/2007 | Tzu | G11C 5/04<br>439/73 |
| 2009/0302876 | A1 | 12/2009 | Koizumi et al. | |

* cited by examiner

CONTACT DEVICE SYSTEM

This nonprovisional application claims priority under 35 U.S.C. §119(a) to German Patent Application No. 10 2015 010 776.3, which was filed in Germany on Aug. 20, 2015, and which is herein incorporated by reference.

BACKGROUND OF THE INVENTION

Field of the Invention

The invention relates to a contact device system.

Description of the Background Art

A contact device system is known, for example, from DE 11 2010 004 846 T5 (which corresponds to U.S. Pat. No. 8,118,602), U.S. Pat. No. 5,528,466, and JP 2004 085 424 A.

Further, US 2009/0302876 A1 describes a contact device for testing a plurality of electronic components, in particular ICs, whereby the contact device has a plurality of contact units, located on a carrier, for a component to be tested and a pressing unit. A functional electrical connection is achieved by placing contact terminals, so-called pins, on the contact surfaces of the contact device. The components in this case are spaced apart from the carrier. The component is pressed against the carrier by a pressing unit, whereby the position and size of the contact area between the component and the contact unit changes depending on the stroke covered. The contact pins are more or less bent depending on the deformability of the contact pins and the exerted force of the pressing unit.

SUMMARY OF THE INVENTION

It is therefore an object of the invention to provide a device that refines the prior art.

According to an exemplary embodiment of the invention, a contact device system is provided that comprises a plate-shaped carrier and a pressing unit, whereby the carrier has a bottom side and a top side, and the pressing unit has a bottom side and a top side, and at least five accommodating areas are disposed on the bottom side of the pressing unit, at least five accommodating areas and at least five contact area pairs are disposed on the top side of the carrier, whereby the contact area pairs each comprise a first electrically conductive contact area and a second electrically conductive contact area, and in each case the first contact area is spaced apart from the second contact area and is electrically insulated therefrom, the first contact area and the second contact area each have a functional electrical connection to an evaluation circuit by means of a trace section, and the electronic components have at least two terminal contacts, whereby after accommodation of the packaged electronic components, the particular component is placed on the top side of the carrier on one of the accommodating areas, and the first terminal contact is placed on the first contact area and the second terminal contact on the second contact area, and the particular component is pressed down by the pressing unit and the first terminal contact is electrically connected to the first contact area and the second terminal contact to the second contact area.

The contact areas can be connected to the evaluation circuit in each case by means of a trace section; i.e., the functional electrical connection is made by means of a trace section.

The electronic component can be present in packaged form. Preferably, the electronic component comprises an integrated circuit and/or a passive electronic component, such as for example, a sensor. The electronic component package can also be called a semiconductor package. It is understood, furthermore, that the packaged electronic component also comprises an integrated circuit, whereby the integrated circuit is preferably formed monolithically in a semiconductor body and preferably also comprises sensors, in particular Hall sensors.

The contact device system can be formed as part of a measuring system, whereby the evaluation circuit is formed in the measuring system. To create the functional electrical connection between the contact device system and the measuring system, a connector or a contact strip can be formed on the carrier. It is understood that the electrically conductive areas are made of a metal or a metallic compound.

The pressing unit can press directly on the terminal contacts. The terminal contacts after the pressing down are reliably connected to the contact areas.

An advantage of the device of the invention is that the packaged electronic components such as, for example, ICs can be measured simply, cost-effectively, and reliably. In particular, the electronic components are fixed in the accommodating areas. The terminal contacts of the electronic components lie frictionally on the contact areas by means of the pressing unit and can be supplied with electrical voltage and/or with current. A function test of the electronic components can be carried out by this means in a simple and reliable manner.

A further advantage is that the pins of the components, in particular the pins of the ICs, can be pressed directly onto the contact sections of the contact elements by pressing unit; i.e., no lever forces occur along the pins. Stated differently, an inelastic deformation of the pins along the longitudinal direction is prevented.

A further advantage is that the electronic components during contacting and measurement in contrast to a soldering process or during the pressing into an adapter experience only little mechanical stress and are not deformed.

The accommodating areas can be formed as pockets. The size of the pockets is designed so that the package of the electronic components is taken up by the pockets form-fittingly. The pocket can be envisaged as a rectangular recess with a hole located at the corner points thereof. If many pockets, i.e., a plurality of pockets, are arranged next to one another or in rows, the arrangement corresponds to a long trench divided into sections by separation walls.

A further advantage is that the electronic parts during contacting and measurement in contrast to a soldering process or in contrast to pressing into an adapter experience only little mechanical stress. The pressing unit and the carrier represent a device that is easily disassembled reversibly and have at least two pieces.

In an embodiment, the contact areas can be formed in the accommodating area in order to contact reliably electronic components in which the terminal contacts are disposed on the package or directly on the package. In particular in the case of an SOIC package or an SMD package form, the contacts of the electronic component are formed directly on the package. Basically, part of the terminal contacts or all terminal contacts are formed directly on an outer side, preferably the bottom side of the package.

In an embodiment, the contact areas of the accommodating area for the package can be formed spaced apart in order to take up and to contact reliably electronic components in which the terminal contacts form pin-like terminal lugs.

In an embodiment, the carrier can have a trench-shaped recess on the top side, whereby part of the accommodating areas is located in the recess and/or, i.e., in addition or alternatively, the pressing unit has a trench-shaped recess on the bottom side.

In an embodiment, the carrier can be closed on the bottom side in the area of the recess, whereby in a further embodiment the carrier can be formed as a plate.

If the recess is formed on the surface as a long trench or as trench-shaped recess for accommodating a plurality of electronic components, a plurality of electronic components can be arranged next to one another in the trench in a simple manner.

In an embodiment, the carrier and/or pressing unit can have a plurality of long trench-shaped recesses spaced apart from one another. It is advantageous very generally, if the recess has a plurality of pockets arranged in rows. It is preferred in particular if uniformly spaced separation walls in the trench-shaped recess project from the bottom area of the recess, and the space between two directly adjacent separation walls corresponds to an external package dimension of an IC or electronic component to be measured. It is especially advantageous if the separation walls are formed in the shape of plates or bars.

In a further embodiment, a plurality of contact areas can be arranged along the accommodating areas. This makes it possible for the plurality of electronic components, arranged next to one another in the trenches, to be contacted simultaneously. It is advantageous in particular hereby if the pressing unit is formed as a strip.

In an embodiment, the pressing unit can be formed as plate and has strip-shaped elastic areas, whereby the length of the strip-shaped elastic areas corresponds substantially to the length of the accommodating areas. An advantage is that with the spring properties of the elastic material, height tolerances between the different contacts of the electronic component can be compensated and/or the terminal contacts can be pressed gently onto the contact areas. To this end, the elastic areas are arranged such that the terminal contacts are pressed onto the contact areas by the elastic areas. Tests have shown that both a reliable electrical contacting and an increase in the service life of the contact areas can be achieved in this way.

In an embodiment, the pressing unit and the carrier each can have at least two alignment marks. An advantage is that the pressing unit and the carrier can be easily aligned to one another with use of the alignment marks. In a further embodiment, the pressing unit and the carrier are connected to one another by a fastening element, for example, by a screw or by a bayonet catch.

In an embodiment, the recess has a length between 2 mm and 40 cm and/or a width between 2 mm and 2 cm. Preferably the depth of the recess is between 0.05 mm and 3 mm.

The carrier can have a plurality of trace layers and an unbundling of the plurality of contact areas on the carrier is carried out by the traces. It is advantageous, furthermore, to connect the traces with the contact areas in order to conduct signals from the evaluation circuit to the contact areas. Preferably, the traces are arranged in a number of layers on the carrier.

In an embodiment, accommodating areas can be provided on the surface of the pressing unit. Accommodating areas of this type can extend over the entire width of the pressing unit. It is advantageous, furthermore, if the pressing unit in the accommodating areas or at a distance therefrom also comprises contact area pairs or comprises in addition conductive contact surfaces in order to form an electrical contact to the terminal contacts by means of the contact surfaces.

In an embodiment the pressing unit comprises one or more metal layers. As a result, an unbundling can also be formed within the pressing unit. It is understood that the individual metal layers are connected by vias or through-holes.

In am embodiment, both the carrier and the pressing unit can have contact areas or contact surfaces. Because of this, in the case of terminal contacts formed as terminal lugs a so-called force-sense measurement can be carried out in a simple manner.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
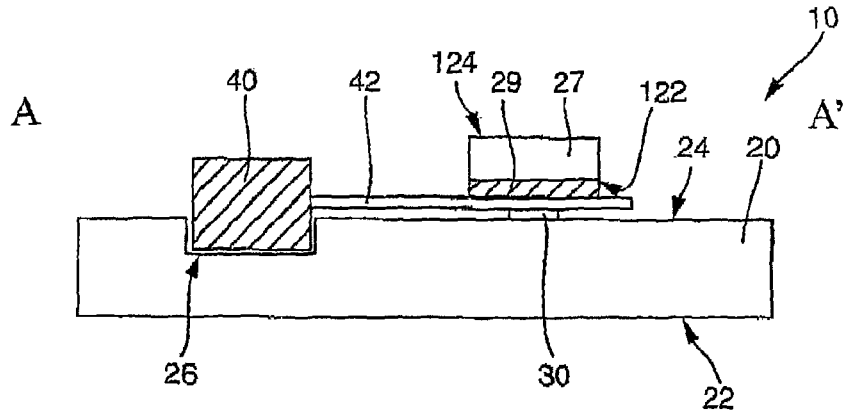
FIG. 1*a* shows a cross-sectional view of an embodiment of the invention.
Figure 1B:
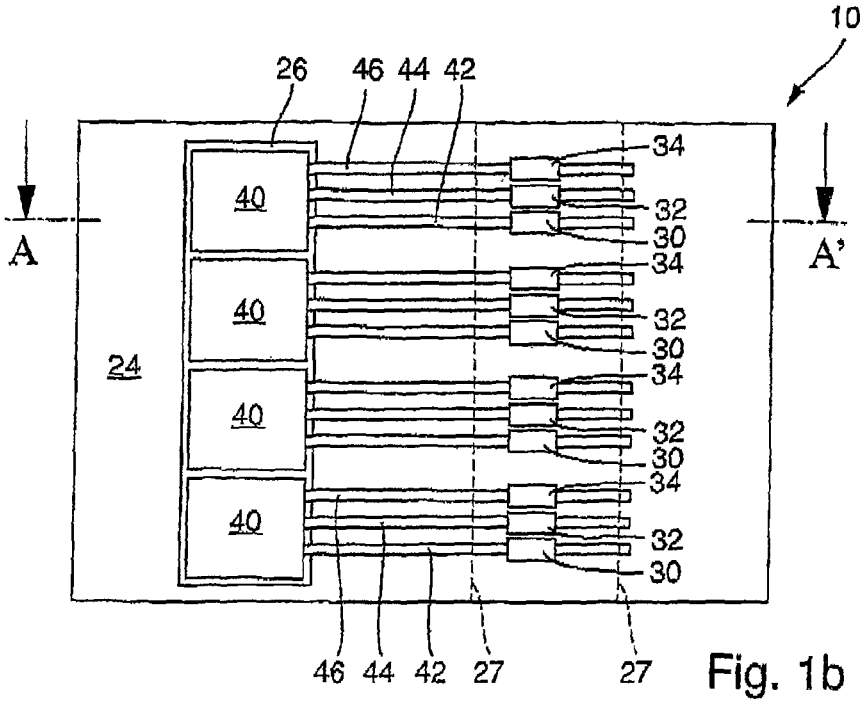
FIG. 1*b* shows a plan view of the embodiment illustrated in FIG. 1*a;*

The illustration in FIG. 1*a* shows a cross-sectional view along a section line A-A' of the embodiment shown in FIG. 1*b* of a first embodiment, having a contact device system 10 with a plate-shaped carrier 20. Carrier 20 has a bottom side 22, a top side 24, and a recess 26 formed on top side 24. Contact device system 10 comprises a pressing unit 27 with a bottom side 122 and a top side 124. An elastic area 29 formed as a plastic layer is located on bottom side 122 of pressing unit 27. In the present case, bottom side 122 is completely covered by the plastic layer. It is understood, however, that in an alternative embodiment that is not shown the plastic layer is also made smaller. Pressing unit 27 is shown in cross section and is formed in the shape of a strip in the present embodiment. A first electrically conductive contact area 30 is formed on top side 24 of carrier 20. A second electrically conductive contact area 32 and a third electrically conductive contact area 34 are not shown. All contact areas 30, 32, and 34 are spaced apart and electrically insulated from one another (this is not shown). It is understood that first contact area 30 and second contact area 32 and third contact area 34 each have a functional electrical connection to an evaluation circuit (not shown) by means of a tracer section (not shown).

Recess 26 on top side 24 of carrier 20 accommodates a first part of an electronic component 40, whereby packaged IC 40 has a first terminal contact 42. The size of recess 26 is matched to the size of IC package 40. First metallic terminal contact 42 is arranged along top side 24 of carrier 20 and lies with a part on first contact area 30. A second metallic terminal contact 44 and a third metallic terminal contact 46 are not shown. Areas 29 of pressing unit 27 press the part, lying thereupon, of first terminal contact 42 onto first contact area 30 in order to create a reliable electrical contact.

A plan view of the embodiment, illustrated in FIG. 1*a*, is shown in the illustration of FIG. 1*b*. Only the differences from the illustration in FIG. 1*a* will be explained below. Recess 26 is formed like a trench and accommodates the first part of four electronic components 40 arranged next to one another. Three metallic terminal contacts 42, 44, and 46 of individual ICs 40 are arranged on the respective contact areas 30, 32, and 34. The strip-shaped pressing unit 27, shown as a dashed line, covers those parts of terminal contacts 42, 44, and 46 that lie above contact areas 30, 32, and 34.

Figure 2:
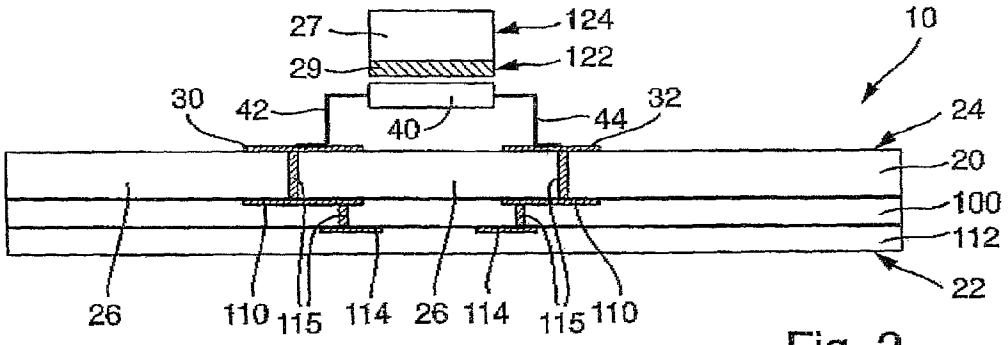
FIG. 2 shows a cross-sectional view of an embodiment of the invention.

The illustration in FIG. 2 shows a cross-sectional view of an embodiment. Only the differences relative to the illustrations in the previous figures will be explained below. In the case of carrier 20, first contact area 30 and second contact area 32 are now arranged parallel to one another. In the present case, accommodating area for accommodating IC 40 comprises the entire area between first contact area 30 and second contact area 32.

Carrier 20 has on top side 24 a first trace layer 100 with traces 110 and a second trace layer 112 with traces 114. Traces 114 are connected to traces 110 and traces 110 are connected to contact surfaces 30 and 32 by means of through-holes 115. Rewiring can be easily carried out due to the plurality of trace layers.

IC 40 is pressed onto carrier 20 by pressing unit 27, so that first metallic terminal contact 42 lies on first contact area 30 and second metallic terminal contact 44 on second contact area 32 and forms a reliable electrical contact.

Figure 3:
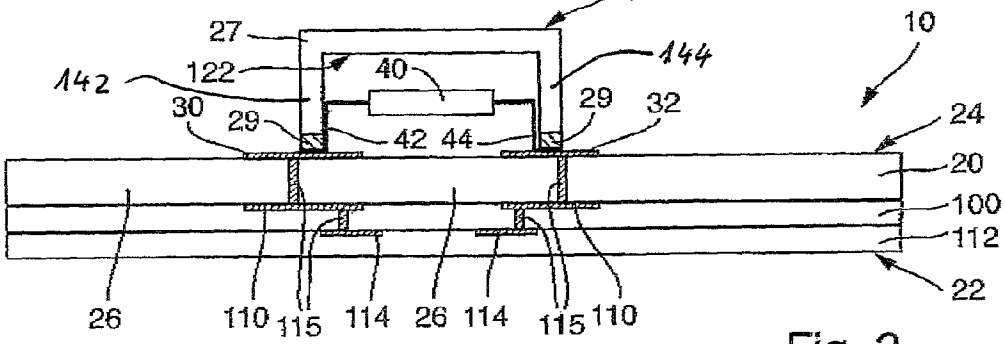
FIG. 3 shows a cross-sectional view of an embodiment of the invention.

The illustration in FIG. 3 shows a cross-sectional view of an embodiment. Only the differences relative to the illustrations in the previous figures will be explained below. Pressing unit 27 has on bottom side 122 a first formation 142 with first metallic terminal contact 42 on first contact area 30 and a second formation 144 with second metallic terminal contact 44 on second contact area 32. Stated differently, pressing unit 27 in the present embodiment has a u-shaped cross section, whereby terminal contacts 42 and 44 are pressed onto contact areas 30 and 32 by means of the two shank-like formations 142 and 144.

Figure 4:
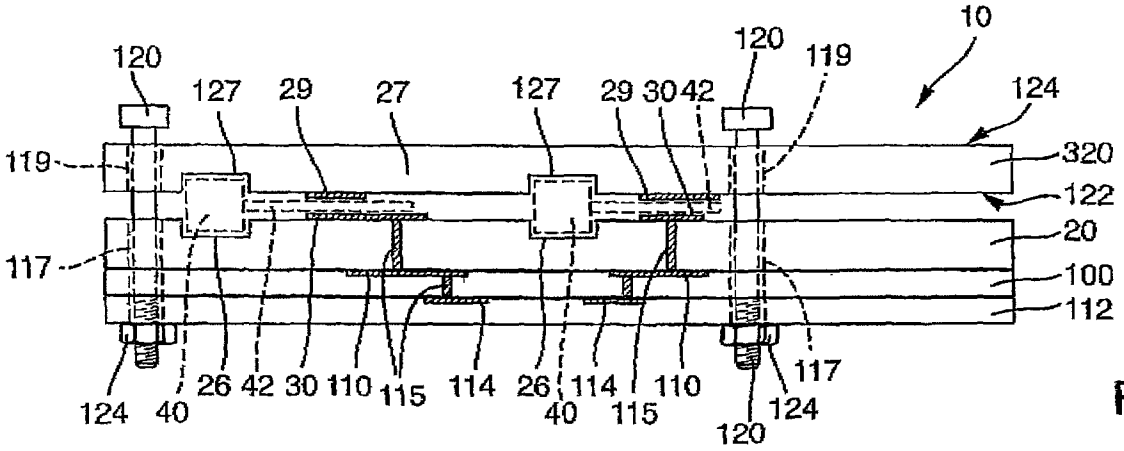
FIG. 4 shows a cross-sectional view of an embodiment of the invention.

The illustration in FIG. 4 shows a cross-sectional view of an embodiment. Only the differences relative to the illustrations in the previous figures will be explained below. Carrier 20 now comprises two trench-shaped recesses 26 arranged parallel to one another. Both recesses 26 are configured to accommodate packaged ICs 40 (shown by the dashed lines). Carrier 20 on the bottom side has first trace layer 100 with traces 110 and second trace layer 112 with traces 114. Traces 114 are connected to traces 110 and traces 110 are connected to contact surfaces 30, 32, and 34 by through-holes 115. The carrier has holes 117 formed as alignment aids.

Pressing unit 27 is made plate-shaped and covers the entire area having two trench-shaped recesses 26 with electronic components 40 and terminal contacts 30, 32, and 34. Pressing unit 27 has two trench-shaped recesses 127 to accommodate a second part of electronic components 40 and has two elastic areas 29, formed as strips, to press the pin-like terminal lugs 42, 44, and 46 formed as terminal contacts reliably onto the associated contact areas 30, 32, and 34. An advantage is that the terminal lugs are not bent when being pressed together. Pressing unit 27 has a plurality of holes 119 as alignment aids or alignment marks.

To center pressing unit 27 with carrier 20, holes 119 of pressing unit 27 align with holes 117 of carrier 20. It is possible to connect pressing unit 27 to carrier 20 by means of a fastening element. In particular, the two parts 20, 27 can be secured against slipping by means of the fastening element and the reliability increased. Further, the contact pressure can be adjusted to achieve reliable contacting.

In the present case, screws 120 with nuts 124, which go through holes 117 and 119, are provided as fastening elements. Pressing unit 27 and carrier 20 are pressed together by screws 120.

Figure 5:
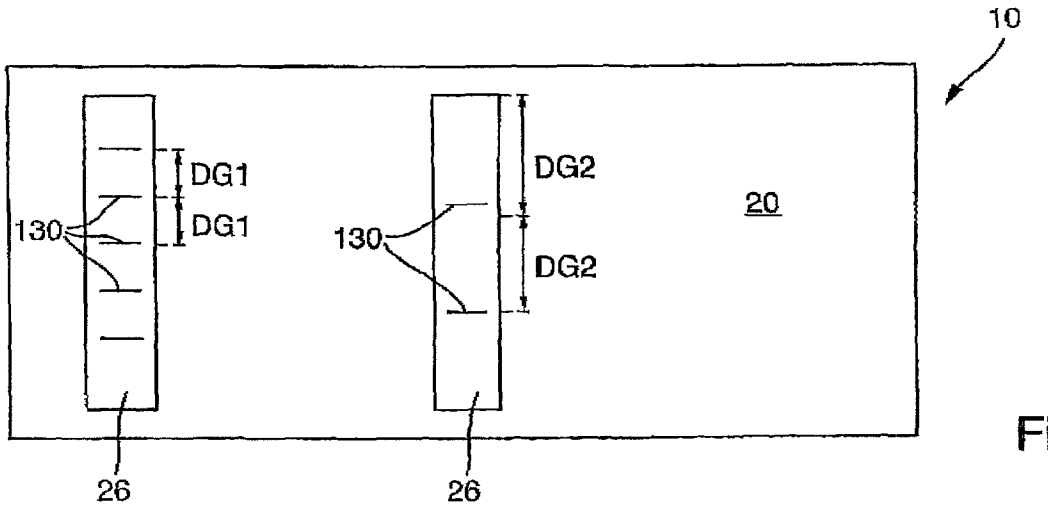
FIG. 5 shows a plan view of a carrier according to an embodiment.

A plan view of an embodiment of a carrier is shown in FIG. 5. Only the differences relative to the illustrations in the previous figures will be explained below. Carrier 20 has separation walls 130 in the two recesses 26. Separation walls 130 project from the trench bottom. The trench-shaped recess can be understood as a plurality of joined pockets or pockets arranged side-by-side or, in other words, as a trench divided into sections. Separation walls 130 preferably have a plate-shaped design. It should be noted that bar-shaped separation walls 130 are also sufficient. In the left trench, two directly adjacent separation walls 130 have a distance DG1, whereas in contrast in the right trench two directly adjacent separation walls 130 have a greater distance DG2. It should be noted that the distance between two directly adjacent separation walls 130 corresponds to an external dimension of electronic component 40. ICs 40 can be secured against slipping in the longitudinal direction of the particular trench by separation walls 130.

Figure 6:
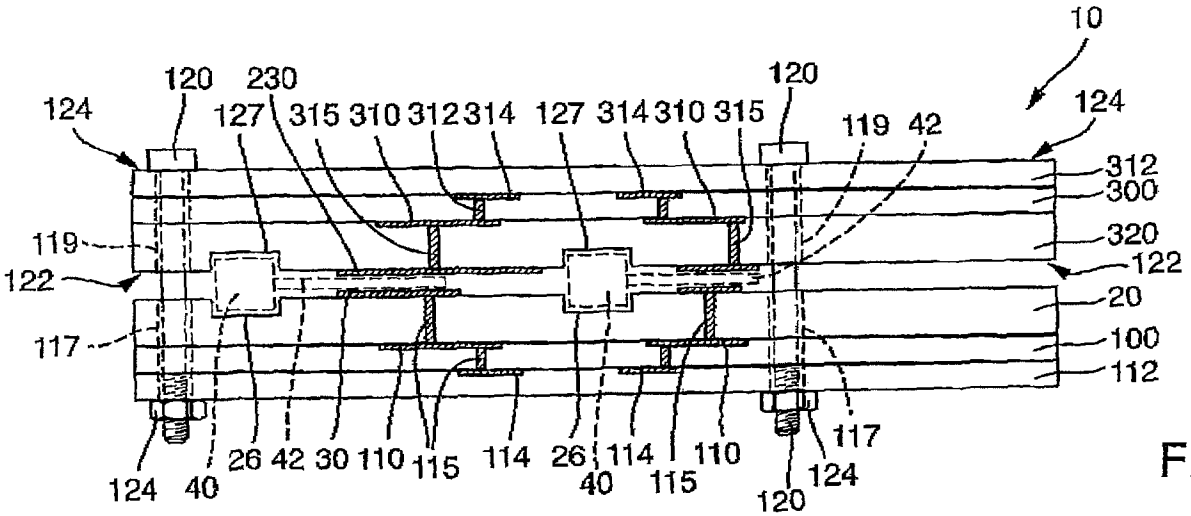
FIG. 6 shows a cross-sectional view of an embodiment of the invention.

A cross-sectional view of a sixth embodiment of a carrier 20 with a pressing unit 27 is shown in FIG. 6. Only the differences relative to the illustrations in the previous figures will be explained below. Pressing unit 27 on the top side has a first trace layer 300 with traces 310 and a second trace layer 312 with traces 314. Traces 314 are connected to traces 310 and traces 310 are connected to contact surfaces 230, and two other contact surfaces (not shown) by means of through-holes 315. Rewiring can be easily carried out due to the plurality of trace layers.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A contact device system comprising:

a plate-shaped carrier that has a bottom side and a top side;

a pressing unit that has a bottom side and a top side;

at least five first recesses arranged on the bottom side of the pressing unit;

at least five second recesses arranged in the top side of the carrier;

at least five contact area groups arranged on the top side of the carrier, the contact area groups each comprising a first electrically conductive contact area and a second electrically conductive contact area, the first contact area being spaced apart from the second contact area and being insulated electrically therefrom, the first contact area and the second contact area each having a trace connecting to an evaluation circuit; and at least five electronic components each having at least two terminal contacts, the at least two terminal contacts comprising a first terminal contact and a second terminal contact, wherein each of the first recesses and second recesses accommodate one of the electric components, wherein each of the electronic components is placed on the top side of the carrier in one of the second recesses and the first terminal contact is placed on the first contact area and the second terminal contact is placed on the second contact area, wherein the terminal contacts of the electronic component are pressed down by the pressing unit such that the first terminal contact is electrically connected to the first contact area and the second terminal contact to the second contact area, and wherein elastic areas of the pressing unit are arranged such that the terminal contacts are pressed onto the first and second contact areas by the elastic areas, and wherein the terminal contacts are pressed directly by the pressing unit perpendicular to a main extension direction of the terminal contacts, the first and second terminal contacts extending straight from each electronic component to the first contact area and the second contact area.

2. The contact device system according to claim 1, wherein the terminal contacts are formed on the electronic component, and wherein the first and second contact areas are spaced apart from each of the first and second recesses.

3. The contact device system according to claim 1, wherein the second recesses of the carrier form a trench-shaped recess on the top side.

4. The contact device system according to claim 3, wherein the carrier and/or the pressing unit have a plurality of long trench-shaped recesses spaced apart from one another.

5. The contact device system according to claim 3, wherein the trench-shaped recess has a plurality of pockets arranged in rows.

6. The contact device system according to claim 3, wherein uniformly spaced separation walls in the trench-shaped recess project from a bottom area of the trench-shaped recess, and wherein a uniform space between two directly adjacent separation walls corresponds to an external package dimension of one of the electronic components.

7. The contact device system according to claim 1, wherein the carrier and/or the pressing unit are made as plates.

8. The contact device system according to claim 5, wherein the contact area groups are arranged along the pockets.

9. The contact device system according to claim 1, wherein the pressing unit is formed in the shape of a strip.

10. The contact device system according to claim 1, wherein the elastic areas of the pressing unit are strip-shaped, wherein a length of the strip-shaped elastic areas corresponds substantially to a length of the first or second recesses.

11. The contact device system according to claim 10, wherein the pressing unit has two formations on a bottom side to press the first and second terminal contacts onto the first and second contact areas.

12. The contact device system according to claim 1, wherein the pressing unit comprises conductive contact surfaces, wherein the contact surfaces are arranged such that the contact terminals form an electrical contact with the contact surfaces, and wherein the pressing unit comprises a plurality of metal layers.

13. The contact device system according to claim 1, wherein the pressing unit and the carrier each have at least two alignment marks in order to align the pressing unit and the carrier to one another with use of the alignment marks.

14. The contact device system according to claim 3, wherein the trench-shaped recess has a length between 2 mm and 40 cm and/or a width between 2 mm and 2 cm.

15. The contact device system according to claim 3, wherein a depth of the trench-shaped recess is between 0.05 mm and 3 mm.

16. The contact device system according to claim 1, wherein the carrier has a plurality of trace layers and an unbundling is carried out on the carrier by the traces, and wherein the traces are connected to the contact lead groups in order to conduct signals to the contact or as area groups.

17. The contact device system according to claim 1, wherein the pressing unit has a plurality of trace layers and an unbundling on the pressing unit is carried out by the traces.

18. The contact device system according to claim 1, wherein the pressing unit and the carrier are connected to one another by a fastening element.

19. The contact device system according to claim 1, wherein the traces are provided below the bottom side of the carrier.

20. The contact device system according to claim 1, wherein the pressing unit directly presses down on the terminal contacts with the first and second contact areas opposite the pressing unit.

21. The contact device system according to claim 1, wherein the terminal contacts connect with the traces via the contact area groups.

22. The contact device system according to claim 1, wherein the first recesses extend upward into the pressing unit towards the top side of the pressing unit, and wherein the second recesses extend downward towards the bottom side of the carrier.

23. A contact device system comprising:

a plate-shaped carrier that has a bottom side and a top side;

a pressing unit that has a bottom side and a top side;

at least five contact area groups arranged on the top side of the carrier, the contact area groups each comprising a first electrically conductive contact area and a second electrically conductive contact area, the first contact area being spaced apart from the second contact area and being insulated electrically therefrom, the first contact area and the second contact area each having a trace connecting to an evaluation circuit; and at least five electronic components each having at least two terminal pins, the at least two terminal pins comprising a first terminal pin and a second terminal pin, wherein the first terminal pin is placed on the first contact area and the second terminal pin is placed on the second contact area, wherein the terminal pins of each electronic component are pressed down by the pressing unit such that the first terminal pin is electrically connected to the first contact area and the second terminal pin to the second contact area, and wherein elastic areas of the pressing unit are arranged such that the first and second terminal pins are pressed onto the first and second contact areas by the elastic areas, and wherein the terminal pins are pressed, by the pressing unit, perpendicular to a main extension direction of the terminal pins, the first and second terminal pins extending straight from each electronic component to the first contact area and the second contact area.

24. The contact device system according to claim 23, wherein the bottom side of the pressing unit is in direct contact with each terminal pin and the first and second terminal pins directly contact the first and second contact areas.

25. The contact device system according to claim 24, wherein the main extension direction of the terminal pins is parallel to a plane containing the first and second contact areas.

* * * * *